United States Patent [19]

Johnson, Jr.

[11] 4,255,130

[45] Mar. 10, 1981

[54] APPARATUS AND METHOD FOR TREATING AN AGGREGATE MATERIAL WITH A FLOWING GAS

[76] Inventor: Allen S. Johnson, Jr., P.O. Drawer 1037, Salisbury, N.C. 28144

[21] Appl. No.: 88,522

[22] Filed: Oct. 26, 1979

[51] Int. Cl.[3] ..... F27B 15/00

[52] U.S. Cl. ..... 432/14; 34/171; 432/58; 432/106

[58] Field of Search ..... 432/14, 16, 17, 58, 432/97, 106; 34/171

[56] References Cited

U.S. PATENT DOCUMENTS

| | | | |
|---|---|---|---|
| 3,592,453 | 7/1971 | Jager | 34/79 |
| 3,741,715 | 6/1973 | Sylvest | 432/58 |
| 4,188,185 | 2/1980 | Suh et al. | 432/58 |

FOREIGN PATENT DOCUMENTS

| | | | |
|---|---|---|---|
| 277495 | 8/1914 | Fed. Rep. of Germany | 34/171 |
| 725858 | 10/1942 | Fed. Rep. of Germany | 34/171 |

*Primary Examiner*—John J. Camby

*Attorney, Agent, or Firm*—Bell, Seltzer, Park & Gibson

[57] ABSTRACT

Relatively coarse aggregate is preheated continuously and in a highly effective manner by directing the aggregate downwardly along a predetermined path of travel while maintaining the aggregate in the form of a relatively thin layer and while directing a flowing heated gas upwardly along a predetermined sinuous path of travel repeatedly passing laterally back and forth through the downwardly moving layer of aggregate from opposite sides thereof to thus provide highly effective contact of the gas with the aggregate. The thin layer of aggregate is guided downwardly along a passageway formed by a pair of gas permeable retaining walls which extend generally vertically in opposing spaced relation to one another. The retaining walls are of a nonlinear zigzag configuration so arranged as to direct the thin layer of aggregate along a sinuous path of travel in the course of its downward movement along the elongate passageway.

15 Claims, 5 Drawing Figures

APPARATUS AND METHOD FOR TREATING AN AGGREGATE MATERIAL WITH A FLOWING GAS

FIELD OF THE INVENTION

This invention relates to an improved apparatus and method for treating a solid aggregate material with a flowing gas, and in particular to an improved method and apparatus for use in conjunction with a rotary kiln for preheating the aggregate with the waste gases from the kiln prior to introduction of the aggregate into the kiln.

BACKGROUND OF THE INVENTION

In manufacturing operations in which minerals are heat treated by passing through a rotary kiln at elevated temperature, a preheater apparatus is commonly provided at the feed or input end of the rotary kiln for preheating the incoming materials by contact with the waste heated gases which are discharged from the kiln.

Where relatively fine granular materials are involved, the preheater apparatus frequently takes the form of a series of cyclone housings which provide for a cascading flow of the granular material in contact with the heated gases. Preheaters of this general type are shown, by way of example, in U.S. Pat. Nos. 3,738,794; 4,004,876; 4,022,568 and 4,105,396.

Where the minerals undergoing heat treatment are in the form of relatively coarse aggregate, a different type of preheater apparatus must be employed. One commercially available preheater which is designed for handling relatively coarse aggregate materials operates on a batchwise basis and utilizes a device which positions a static bed of the aggregate in the flow of the heated gas, with a massive plunger device being provided for periodically emptying the bed of the preheated aggregate in preparation for refilling the bed with fresh aggregate. Other types of preheater devices designed for handling solid aggregate materials are shown in U.S. Pat. Nos. 3,159,386; 3,671,027; 3,883,294; and 4,038,025.

The previously available aggregate preheaters of which applicant is aware are of relatively massive size and are quite expensive. The preheaters typically have a number of moving parts which are subject to high temperature and to temperature changes and thus generally require a considerable amount of maintenance. Additionally, the aggregate preheaters of which applicant is aware are relatively inefficient, allowing a significant amount of usable heat energy to remain in the waste gases which are discharged to the atmosphere. Because of this inefficiency and the relatively high temperature of the waste gases discharged from the preheater, it is generally necessary with the prior types of aggregate preheaters to provide some way to cool the gases after passing through the preheater and prior to filtering the gases in a baghouse. This is typically accomplished using either an auxiliary cooling apparatus or by bleeding in ambient outside air to mix with the heated gases and thus reduce the temperature of the gases. The former approach involves additional energy consumption, while the latter approach increases the load on the filtering system and thus increases the size and expense of the filter.

With the foregoing in mind, it is an object of the present invention to provide an improved apparatus and method for preheating aggregate in conjunction with a rotary kiln and which overcomes the aforementioned disadvantages and limitations of the preheater devices and methods heretofore available.

It is another object of this invention to provide an aggregate preheater apparatus and method which is highly effective in transferring heat from the waste gases to the aggregate being processed therethrough.

It is a further object of this invention to provide an aggregate preheater of simple, inexpensive, and maintenance-free construction.

A further object of this invention is to provide an aggregate preheater which is constructed so as to assist in removing dust from the aggregate to thereby reduce the load on the filtering apparatus.

Still another object of this invention is to provide an apparatus and method of the type generally described which is useful not only for preheating aggregate, but in other applications where aggregate is treated by contact with a flowing gas.

Still another object of this invention is to provide an improved apparatus and method for continuously treating a solid aggregate with a flow of gas characterized by providing highly effective contact of the aggregate with the gas.

SUMMARY OF THE INVENTION

In accordance with the invention, the aggregate is treated continuously and in a highly effective manner by directing the aggregate downwardly along a predetermined path of travel while maintaining the aggregate in the form of a relatively thin layer and while directing a flowing gas upwardly along a predetermined sinuous path of travel repeatedly passing back and forth through the thin layer of aggregate from opposite sides thereof to thus provide highly effective contact of the gas with the aggregate. The thin layer of aggregate is guided laterally back and forth along a series of oppositely directed downwardly inclined courses of travel, and the flowing gas passes upwardly through the thin layer of aggregate on each of the oppositely directed downwardly inclined courses of travel thereof. The flowing gas thus passes repeatedly back and forth through the thin layer of aggregate from opposite sides thereof, each time entering the inclined layer of aggregate from the underside thereof and emerging from the upper side of the inclined layer. This provides for an intimate contacting of the aggregate by the flowing gas so as to achieve a very efficient transfer of heat therebetween. Additionally, the inclined path of travel of the aggregate and the relationship of gas flow thereto assists in removing any dust particles which might be present in the thin layer of aggregate and carrying the dust particles away with the flowing gas.

In treating the aggregate in the manner described, the apparatus of the present invention utilizes a pair of gas permeable retaining walls which are positioned in opposing closely spaced relation to one another so as to define therebetween an elongate generally vertically extending passageway of relatively narrow cross section which is adapted for receiving the aggregate at the upper end thereof and directing the aggregate therealong in a predetermined downward path of travel in the form of a relatively thin downwardly moving layer. The pair of retaining walls are of a nonlinear zigzag configuration, each being comprised of a series of interconnected inclined segmental wall portions so arranged as to direct the thin layer of aggregate along a sinuous path of travel in the course of its downward movement along the elongate passageway. The opposing gas permeable retaining walls are formed by a respective series of parallel laterally extending slats, the slats in the opposing series being convergingly arranged and inclined angularly downwardly in spaced apart relation from one another to readily permit the flow of gas therebetween. The slats are inclined angularly downwardly in the direction of movement of the aggregate and are positioned in overlapping relation to one another to assist in guiding the aggregate along its downward path of travel while confining the aggregate within the elongate passageway.

The apparatus of this invention may be effectively utilized in association with a rotary kiln for preheating the aggregate by contact with the waste heated gases from the kiln prior to introducing the aggregate into the kiln. When so utilized, the highly efficient heat transfer characteristics of the preheater apparatus achieves a very significant lowering of the temperature of the waste gases from the kiln, and a significant preheating of the aggregate. This reduces the overall fuel requirements for the kiln and permits increasing its rate of production. Additionally, the relatively cool gases emerging from the preheater may be directly filtered and discharged, without the necessity of additional cooling as has been generally necessary with prior aggregate preheaters.

BRIEF DESCRIPTION OF THE DRAWINGS

Some of the features and advantages of the invention having been stated, others will become apparent as the description proceeds when taken in connection with the accompanying drawings, in which.

DESCRIPTION OF ILLUSTRATED EMBODIMENT

Figure 1:
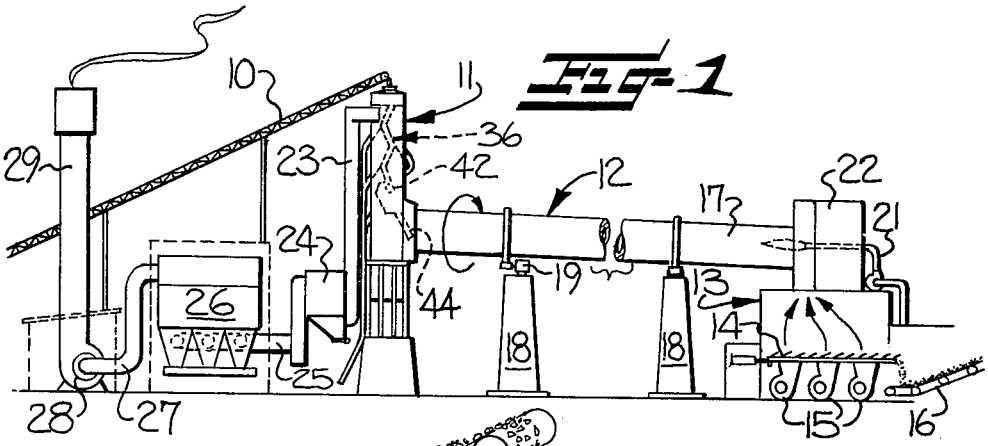
FIG. 1 is a somewhat schematic elevational view showing an assembly of apparatus for processing aggregate in a kiln, and showing an aggregate preheater constructed in accordance with this invention for preheating the aggregate prior to introducing the same into the kiln.

Referring now more particularly to the drawings, FIG. 1 illustrates an assembly of apparatus for processing and heat treating an aggregate material through a rotary kiln. Such an apparatus may be useful, for example, for calcining limestone or for roasting various other kinds of minerals or ores. The minerals or other materials which are processed through the illustrated apparatus are referred to herein by the term "aggregate," but it is to be understood that this term is not intended to be limited to a mineral or rock of any particular chemical composition. The illustrated apparatus is particularly designed for processing relatively coarse aggregate in the form of chunks of a size up to about two to three inches across, as distinguished from fine granular or powdered materials of a size comparable to sand, for example. The illustrated apparatus is particularly suited for processing aggregate which has been at least partially preclassified as to size, and preferably within the size range of from about three-fourths inch to about one and one-half inches.

The apparatus illustrated in FIG. 1 includes a conveyor 10 for conveying the aggregate from a supply source, not shown, to the upper end of an aggregate preheater, generally indicated by the reference character 11. The aggregate is advanced slowly downwardly through the preheater 11, as described more fully later, while being contacted with the heated waste gases emerging from a rotary kiln, generally indicated by the reference character 12. The aggregate is thus preheated by the heated waste gases of the kiln prior to being introduced into the kiln 12. The preheated aggregate is then advanced longitudinally through the rotary kiln 12 while being heated to the desired temperature, and is discharged from the kiln at the opposite end thereof and deposited in an aggregate cooler, generally indicated by the reference character 13. The cooler 13 is of a known construction and includes a grate 14 on which the heated aggregate is deposited, and a plurality of fans 15 mounted for directing air through the grate 14 and into contact with the heated aggregate for cooling the same. The thus cooled aggregate is removed from the grate 14 and deposited on a conveyor 16 which conveys the aggregate elsewhere for storage or subsequent use.

The air which passes through the aggregate in the cooler 13 is heated by the aggregate and is directed from the cooler 13 into one end of the elongate rotary kiln 12. The kiln, more particularly, includes an elongate hollow tubular body 17 which is mounted for rotation about its longitudinal axis on suitable supporting columns 18, with a drive motor 19 being suitably connected to the tubular body for imparting rotation thereto in the direction indicated by the arrow. The tubular body 17 is oriented on a gradual incline as is conventional, so that rotation of the tubular body will gradually advance the aggregate longitudinally through the kiln. The kiln 12 further includes a burner 21, fired by powdered coal or other suitable fuel, and mounted in a suitable housing 22 at the discharge end of the tubular body 17. The burner 21 directs a flame longitudinally into the interior of the tubular body 17 of the kiln for thus heating the aggregate contained in the kiln to a desired temperature. The heated air and the combustion gases from the burner 21 travel longitudinally through the hollow tubular body 17 of the kiln in a direction countercurrent to the direction of movement of the aggregate therethrough and flow from the opposite end of the tubular body into the preheater 11. Here the heated gases are brought into contact with the incoming aggregate for thus preheating the aggregate prior to its introduction into the kiln 12 while at the same time lowering the temperature of the discharge gases. The gases are discharged from the preheater 11 at the upper end thereof and are directed via a duct 23 to a dust collection box 24 where heavier particles of dust and other particulate matter are separated from the flowing gas stream. The gases are then directed via a duct 25 to a suitable filtration apparatus, generally indicated by the reference character 26. In the embodiment of the invention illustrated, the filtration apparatus 26 is a baghouse of a type conventionally employed for removing dust and other fine particulate material from a stream of flowing gas, the baghouse containing a plurality of elongate tubular baglike filters. From the filtration apparatus 26 the gases are directed along a duct 27, through a fan 28 which serves for inducing the flow of gases through the baghouse and through the preheater and kiln, with the gases then being discharged to the atmosphere via a smokestack 29.

Typically, the temperature of the gases leaving the kiln 12 is about 1100° F. to 1250° F. After passing through the preheater 11, the gas temperature is lowered to about 150° to 200° F. This very significant reduction in temperature, which is attributable to the high degree of efficiency provided by the preheater apparatus of this invention, permits the exhaust gases to be conveyed directly to the filtering apparatus 26 without the necessity of providing auxiliary cooling means or bleeding in ambient air to reduce the temperature of the gas as has been heretofore necessary in aggregate heat treating systems of this general type. By efficiently capturing the otherwise wasted heat of the discharge gases and transferring such heat to the incoming aggregate, a considerable amount of otherwise wasted energy is saved and the fuel requirements of the burner are reduced. This arrangement additionally permits obtaining a significantly higher production capacity from the kiln so as to thereby process the aggregate at a faster rate.

Figure 2:
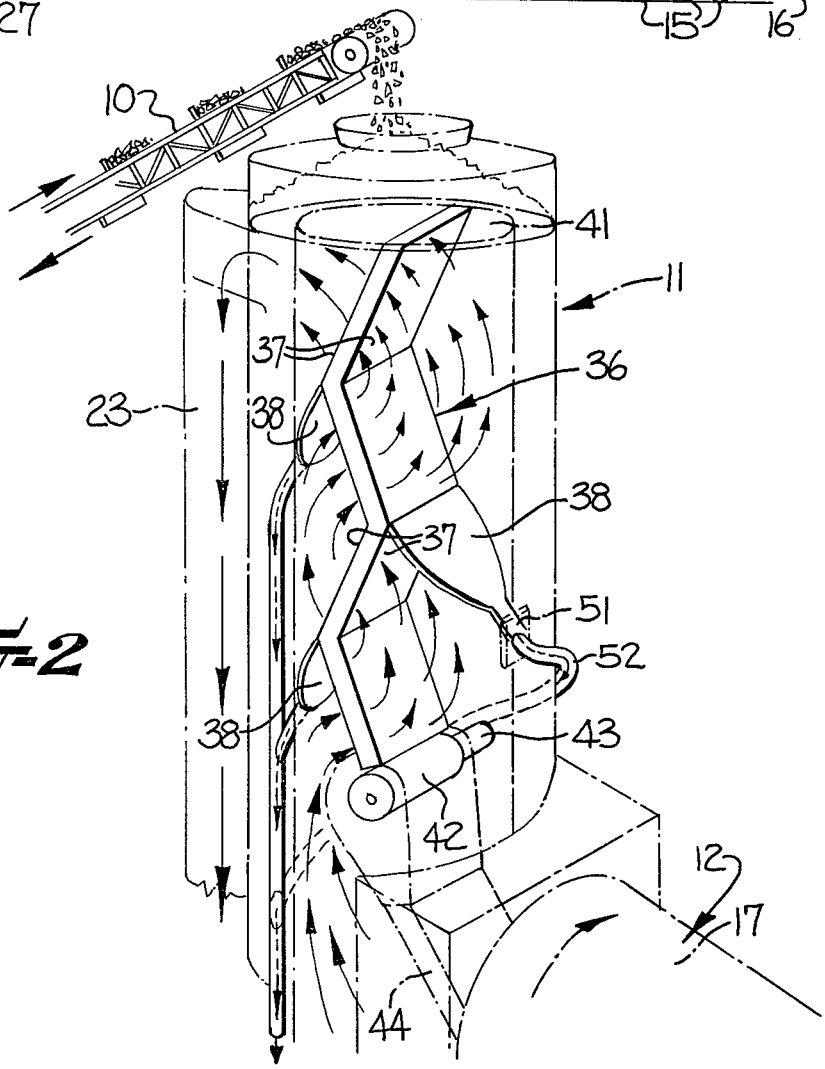
FIG. 2 is a schematic perspective view of the preheater apparatus of this invention with the exterior housing thereof shown in phantom lines to more clearly reveal the interior construction of the preheater.
Figure 3:
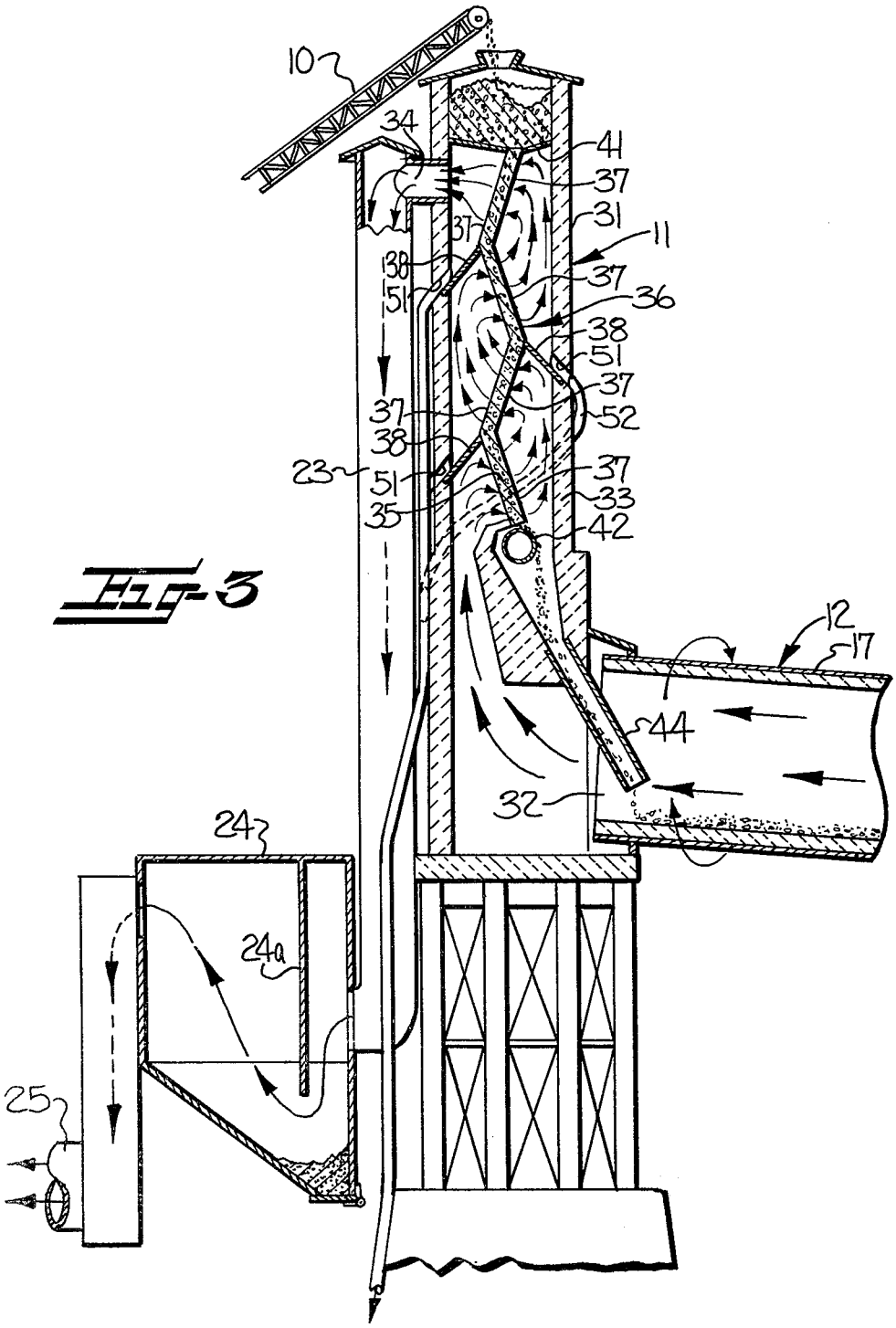
FIG. 3 is a side cross-sectional view of the preheater apparatus.

Referring now more particularly to the construction of the aggregate preheater 11, as best illustrated in FIGS. 2 and 3, it will be seen that the preheater includes an elongate upright hollow housing 31, which in the illustrated embodiment is of a circular cross section. Housing 31 has an inlet opening 32 adjacent the lower end thereof which is communicatively connected to one end of the tubular body 17 of the rotary kiln 12 for receiving the hot waste gases which are discharged therefrom. The housing is lined with a suitable insulating material 33 for protectively insulating the housing 31 and preventing radiation heat losses therefrom. An outlet opening 34 is provided in the housing 31 adjacent the upper end thereof through which the flowing gases leave the housing 31 and are directed along duct 23 to the dust collection box 24.

Located within the housing 31 and extending longitudinally thereof is a pair of retaining walls 36 for the aggregate which are mounted in opposing closely spaced relation to one another to therebetween define an elongate vertically extending passageway or chute 35 for the aggregate. The elongate aggregate passageway 35 is of relatively narrow cross section for receiving the aggregate at the upper end thereof and maintaining the aggregate in the form of a relatively thin layer or bed, as for example four to five inches thick, as it is directed downwardly along the passageway 35. As illustrated, the retaining walls 36 are of a nonlinear zigzag configuration so that the thin layer of aggregate is directed along a sinuous path of travel in the course of its downward movement along the elongate narrow aggregate passageway.

The nonlinear zigzag retaining walls 36 are each comprised of a series of inclined segmental wall portions 37, with each segmental wall portion being inclined at a relatively small angle from the vertical axis. Preferably, the angle of incline of the respective segmental wall portions 37 is within the range of about 10° to about 25° from the vertical axis, and most desirably about 17° to 18°. The respective segmental wall portions which collectively define each retaining wall are so arranged that alternate segmental wall portions are inclined to one side of the vertical axis, with the intervening segmental wall portions being inclined to the opposite side of the vertical axis. The thin layer of aggregate is thus directed laterally back and forth in opposite directions along a series of downwardly inclined courses of travel as it progresses downwardly through the elongate passageway 35.

The retaining walls 36 which form the elongate aggregate passageway or chute 35 are of a gas permeable construction to freely allow the heated gases within the housing 31 to flow through the thin layer of aggregate. As illustrated, the arrangement of the zigzag gas permeable retaining walls 36 within the hollow interior of the housing 31 is such that the heated gases flowing along the interior of the housing are repeatedly directed through the retaining walls 36 and into contact with the thin layer of aggregate which is trapped therebetween. More particularly, it will be seen that a series of baffle plates 38 extend outwardly from the retaining walls 36, to the surrounding housing at spaced locations along the longitudinal extent of the retaining walls so as to direct the flowing gases in the sinuous upward path of travel which repeatedly passes laterally back and forth through the retaining walls and thus repeatedly directs the heated gases into and through the downwardly advancing thin layer of aggregate.

As best seen in FIG. 3, a wall 41 extends between the uppermost ends of the retaining walls 36 and the surrounding housing 31 to define a hopper at the upper end of the housing for receiving a supply of the aggregate with the wall 41 being inclined toward the open upper end of the elongate passageway 35 for directing the aggregate into the passageway. An elongate cylindrical roll 42 is positioned beneath the lower end of the retaining walls 36 in obstructing relationship to the lower end of the passageway 35 so that the passageway remains substantially filled with aggregate. The roll 42 is rotatably driven by a drive motor 43 (FIG. 2) for discharging the aggregate from the lower end of the passageway at a controlled metered rate. Preferably, the speed of rotation of the drive motor 43 is correlated with the speed of rotation of the rotary kiln so that as the speed of the kiln is increased, the speed of the roll 42 is correspondingly increased so as to thereby feed aggregate into the kiln at a faster rate. Upon its discharge from the lower end of the passageway 35, the preheated aggregate falls by gravity through an inlet pipe 44 and into the interior of the rotary kiln 12.

Figure 4:
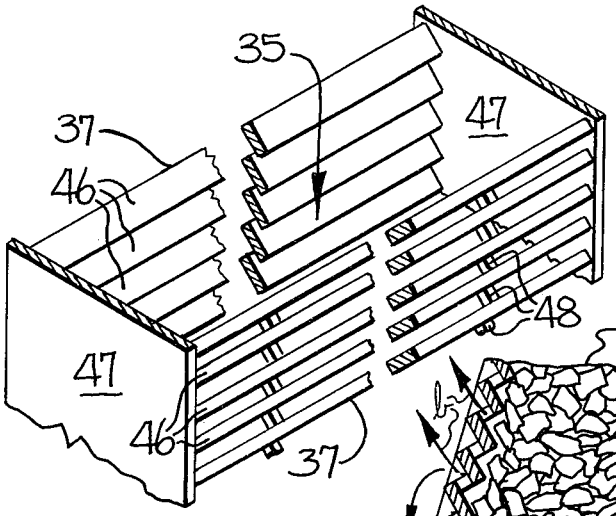
FIG. 4 is a detailed perspective view showing the construction of the aggregate retaining walls in the interior of the preheater.
Figure 5:
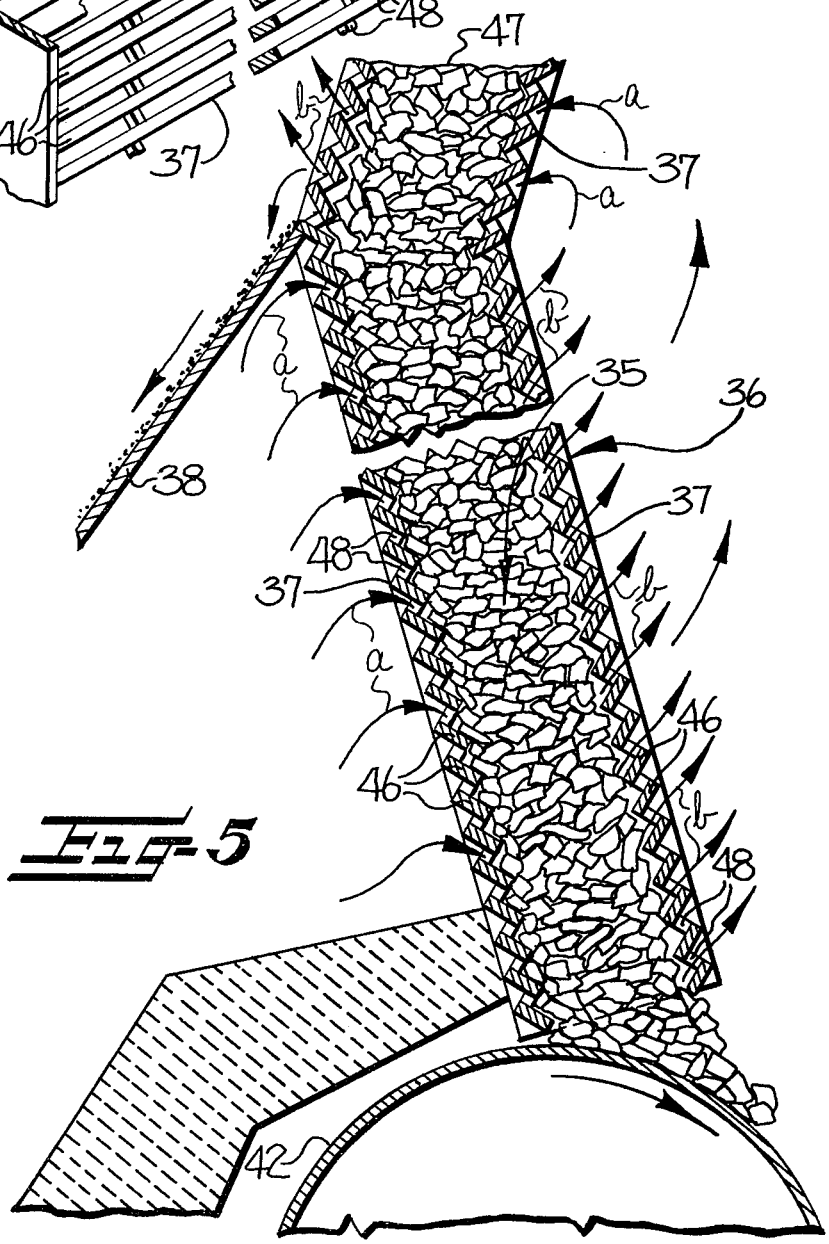
FIG. 5 is an enlarged detailed cross-sectional view of a portion of the preheater apparatus.

As best seen in FIGS. 4 and 5, the gas permeable retaining walls 36 which define the aggregate passageway 35 are of a louvered construction and comprised of a series of parallel laterally extending slats 46 which extend substantially the full width of the chute 35 and are connected to opposing solid end walls 47. The slats 46 in each series are spaced apart from one another to readily permit the flow of gas therebetween, with reinforcing spacers 48 being mounted between adjacent slats at spaced locations across the width thereof to provide enhanced structural rigidity to the retaining wall. As illustrated, the slats 46 are inclined angularly downwardly in the direction of movement of the aggregate and are convergingly arranged with the opposing series of slats. The slats of each series are positioned in overlapping relation to one another to assist in guiding the aggregate along its downward path of travel while confiningly retaining the aggregate within the elongate passageway and while also readily permitting the flow of gas into and through the thin layer of aggregate.

As earlier noted, the respective segmental wall portions 37 which collectively define the retaining walls 36 are oriented at an incline with respect to the vertical axis so that the advancing column of aggregate moves downwardly along an inclined sinuous or zigzag path of travel. The upward flow of gases through the respective segmental wall portions is so arranged that the gases always enter the thin layer of aggregate on the lower of the pair of opposing wall segments, and emerge from the layer from the upper of the pair of segmental wall portions. Thus, as indicated by the air flow arrows a in FIG. 5, the louvered construction of the segmental wall portions 37 causes the heated gases to be directed into the inclined thin layer of aggregate angularly downwardly in generally the same direction as the direction of movement of the aggregate. The flow of the gas thus assists in the downward movement of the layer of aggregate, rather than interfering with or opposing the movement of the aggregate as might occur if the gas flow passed through the layer of aggregate in a different direction. By directing the airflow angularly through the layer of aggregate, the louvered construction of the wall portion 37 also serves to increase the distance which the gas must travel through the layer, thus enhancing contact and heat transfer between the gas and the aggregate.

The inclined angular orientation of the segmental wall portions 37 is also quite significant in obtaining effective removal of dust and other fine particulate material from the aggregate and in preventing clogging of the air passageways between the respective slats 46 as a result of accumulation of dust between the slats. This will best be understood by again referring to FIG. 5. As illustrated, the aggregate which is located closest to the lower of the pair of segmental wall portions 37, i.e. the wall on the inflow side where the air enters the layer of aggregate, is in a relatively compacted state since it bears the weight of the overlying aggregate. However, the aggregate which is located closest to the outflow wall, i.e. the right hand segmental wall portion in FIG. 5, does not bear the weight of the overlying aggregate and is thus more loosely compacted. This permits the looser aggregate to move and turn as it advances downwardly in the column and permits any dust which is carried by the aggregate to be readily swept away by the outflowing current of gases. Furthermore, the slats 46 on the outflow wall are oriented angularly upwardly at a relatively steep incline and, as indicated by the flow arrows b in FIG. 5, the gases are directed between the slats in an angularly upward direction. The relatively steep inclined orientation of the slats assists in keeping the air passageways clear of any accumulated dust, since the exposed surfaces of the slats are inclined too steeply for the dust to accumulate thereon and the flowing air will tend to sweep away any dust which may accumulate on the slat surfaces.

When dust or other particulate material is removed from the column of aggregate, the heavier particles have a tendency to settle out or fall rather than being swept along with the flowing gas stream, and the dust or particulate material settles on the upper surface of the baffle plates 38. As illustrated, the baffle plates are inclined downwardly from the retaining walls 36 outwardly toward the surrounding housing 31 and thus serve for directing the dust or particulate material outwardly toward the housing 31. As best seen in FIG. 2, since the surrounding housing is of a circular cross section, the inclined baffle plates 38 are of a semi-elliptical shape and thus serve to convergingly direct the accumulated dust or particulate material to a common location at the lowest point on the plate. An opening 51 is provided in the wall of the housing 31 at this location through which the accumulated dust may be removed from the housing, and a conduit 52 is communicatively connected thereto for carrying away the dust to a suitable collection site. Similar openings 51 and conduits 52 are associated with each of the baffle plates 38 in the preheater.

Because of the zigzag construction of the retaining walls 36 and the arrangement of the baffle plates 38 and heated gases from the kiln are repeatedly directed through the thin layer of aggregate from alternate directions, i.e. first from one side of the thin layer andd then from the other side thereof. Consequently, a different side or face of the aggregate is exposed to the flowing gases with each pass so as to thereby maximize the transfer of heat from the flowing gases to the aggregate.

After repeatedly passing back and forth through the thin layer of aggregate and reaching the upper portion of the housing 31, the gases have been substantially reduced in temperature and the heat content thereof transferred to the aggregate. The thus cooled gases leave the housing via the outlet opening 34 and are directed along duct 23 to the dust collection box 24, where the gases are directed beneath a baffle 24*a*. Because of the substantially larger cross sectional flow area for the gases inside the dust collection box 24, the gases are substantially reduced in velocity, which permits additional amounts of dust and particulate material, previously entrained in the flowing gas, to drop out of the gas stream prior to the gas stream being directed to the filtering apparatus 26.

While the drawings and specification have illustrated and described how the apparatus and method of this invention may be used as a preheater in association with a rotary kiln, the invention is susceptible to numerous other applications and uses, alone or in association with a kiln or other apparatus. Those skilled in the applicable arts will recognize that the apparatus and method of this invention has broad applicability in situations where it is desirable to contact or treat an aggregate material with a flowing gas.

In the drawings and specification there have been set forth preferred embodiments of the invention, and although specific terms are employed, they are used in a generic and descriptive sense only and not for purposes of limitation.

What is claimed is:

1. In an apparatus for heat treating a solid aggregate, said apparartus including a rotary kiln having an elongate tubular rotatable body through which the aggregate is advanced and including means for directing a heated gas through said tubular body in a direction countercurrent to the movement of the aggregate for heating the aggregate to elevated temperature, the combination therewith of an aggregate preheater cooperating with said kiln for utilizing the heated gases which are discharged from said kiln for preheating the aggregate prior to introduction thereof into said kiln to thus significantly reduce the energy requirements for heat treatment of said aggregate while also significantly increasing the production capacity of said kiln, said preheater comprising means defining a pair of gas permeable retaining walls of nonlinear zigzag configuration extending generally vertically in opposing, spaced relation to one another to define an elongate generally vertically extending gas permeable passageway of relatively narrow cross section adapted for receiving aggregate at the upper end thereof and confiningly directing the aggregate along a predetermined downward path of travel in the form of a relatively thin layer, each of said opposing gas permeable retaining walls being comprised of a series of laterally extending spaced apart slats interconnected to define inclined segmental wall portions inclined at an angle within the range of about 10° to about 25° from the vertical axis and so arranged that alternate segmental wall portions are inclined to one side of the vertical axis, with the intervening segmental wall portions being inclined to the opposite side of the vertical axis and with the slats of the opposing series being convergingly arranged and inclined angularly downwardly in the direction of movement of the aggregate and positioned in overlapping relation to one another to assist in guiding the aggregate along its downward path of travel while confining the aggregate within the passageway and while also readily permitting the flow of heated gas into and through the thin layer of aggregate, and means for receiving the heated gases from said kiln and directing the gases upwardly along a predetermined sinuous path of travel repeatedly passing laterally through each of the inclined segmental wall portions so as to repeatedly direct the gases through the thin layer of aggregate in said passageway to provide highly effective contact of the heated gases with the aggregate.

2. The apparatus as set forth in claim 1 including means cooperating with said passageway at the lower end thereof for controlling the discharge of the aggregate from said passageway.

3. In an apparatus for heat treating a solid aggregate, said apparatus including a rotary kiln having an elongate tubular rotatable body through which the aggregate is advanced and including means for directing a heated gas through said tubular body in a direction countercurrent to the movement of the aggregate for heating the aggregate to elevated temperature, the combination therewith of an aggregate preheater cooperating with said kiln for utilizing the heated gases which are discharged from said kiln for preheating the aggregate prior to introduction thereof into said kiln to thus significantly reduce the energy requirements for heat treatment of said aggregate while also significantly increasing the production capacity of said kiln, said preheater comprising an upright hollow housing having an inlet opening in a lower portion thereof and an outlet opening in an upper portion thereof, means for receiving the heated gases from said kiln and directing the same into the inlet opening of said housing, a pair of opposing gas permeable retaining walls of nonlinear zigzag configuration positioned within said upright housing and extending generally longitudinally thereof in closely spaced relation to one another to define an elongate generally vertically extending passageway of relatively narrow cross section adapted for receiving the aggregate at the upper end thereof and directing the same along a predetermined sinuous downward path of travel in the form of a relatively thin downwardly moving layer, each of said opposing gas permeable retaining walls being comprised of a series of laterally extending spaced apart slats interconnected to define inclined segmental wall portions inclined at an angle within the range of about 10° to about 25° from the vertical axis and so arranged that alternate segmental wall portions are inclined to one side of the vertical axis, with the intervening segmental wall portions being inclined to the opposite side of the vertical axis and with the slats of the opposing series being convergingly arranged and inclined angularly downwardly in the direction of movement of the aggregate and positioned in overlapping relation to one another to assist in guiding the aggregate along its downward path of travel while confining the aggregate within the passageway and while also readily permitting the flow of heated gas into and through the thin layer of aggregate, means cooperating with the respective segmental wall portions of said pair of retaining walls and with the surrounding housing for directing the heated gas flowing within said housing successively through each of said segmental wall portions so as to thereby repeatedly direct the heated gas laterally back and forth through the thin layer of aggregate in said passageway to provide highly effective contact of the gas with the aggregate, and means cooperating with said pair of retaining walls adjacent the lower end thereof for controlling the discharge of the aggregate from said passageway.

4. The apparatus as set forth in claim 3 wherein said means for controlling the discharge of the aggregate from said passageway comprises an elongate roll mounted beneath said pair of retaining walls and cooperating therewith to obstruct the lower end of said passageway, and means for rotating said roll so as to thereby effect discharge of the aggregate from said passageway at a controlled rate.

5. The apparatus as set forth in claim 3 wherein said means cooperating with said segmental wall portions for directing the heated gas successively through each of said segmental wall portions comprises respective baffle plates extending between certain of said segmental wall portions and the surrounding housing.

6. The apparatus as set forth in claim 5 wherein said baffle plates are arranged at an incline extending angularly downwardly and outwardly from said segmental wall portion to the surrounding housing so that any fine particulate material which might escape from said passageway and become deposited on the baffle plate will be directed by gravity downwardly along the surface of the baffle plate toward said housing, and including means associated with said baffle plates to facilitate collecting and removing the fine particulate material.

7. In an apparatus for heat treating a solid aggregate, said apparatus including a rotary kiln having an elongate tubular rotatable body through which the aggregate is advanced and including means for directing a heated gas through said tubular body in a direction countercurrent to the movement of the aggregate for heating the aggregate to elevated temperature, and said apparatus further including filtering means for filtering the waste gas from said rotary kiln to remove entrained particulate material prior to discharge of the gas to the atmosphere, the combination therewith of an aggregate preheater cooperating with said kiln for utilizing the heated gases which are discharged from said kiln for preheating the aggregate prior to introduction thereof into said kiln to thus significantly reduce the energy requirements for heat treatment of said aggregate while also significantly increasing the production capacity of said kiln, and said preheater also serving to lower the temperature of the waste gas to a sufficiently low level to permit filtration thereof without the necessity of auxiliary cooling means or bleeding in of ambient air, said preheater comprising an upright hollow housing having an inlet opening in a lower portion thereof and an outlet opening in an upper portion thereof, means for receiving the heated gases from said kiln and directing the same into the inlet opening of said housing, means for directing the gases from the outlet opening of said housing to said filtering means, means defining a pair of gas permeable retaining walls of nonlinear zigzag configuration extending generally vertically in opposing, spaced relation to one another to define an elongate gas permeable passageway of relatively narrow cross section extending longitudinally within said upright housing and adapted for receiving the aggregate at the upper end thereof and directing the same along a predetermined downward path of travel in the form of a relatively thin downwardly moving layer, each of said opposing gas permeable retaining walls being comprised of a series of laterally extending spaced apart slats interconnected to define inclined segmental wall portions inclined at an angle within the range of about 10° to about 25° from the vertical axis and so arranged that alternate segmental wall portions are inclined to one side of the vertical axis, with the intervening segmental wall portions being inclined to the opposite side of the vertical axis and with the slats of the opposing series being convergingly arranged and inclined angularly downwardly in the direction of movement of the aggregate and positioned in overlapping relation to one another to assist in guiding the aggregate along its downward path of travel while confining the aggregate within the passageway and while also readily permitting the flow of heated gas into and through the thin layer of aggregate, and means cooperating with said housing and with said passageway for directing the heated gas flowing within said housing upwardly along a predetermined sinuous path of travel repeatedly passing laterally back and forth through each of the inclined segmental wall portions and the thin layer of aggregate in said passageway to cool the gases to such a low temperature as to permit the gases to be conveyed directly to said filtering means without danger of damage thereto.

8. Apparatus for treating a solid aggregate with a flowing gas, said apparatus comprising an upright hollow housing having an inlet opening in a lower portion thereof for receiving a flowing gas and an outlet opening in an upper portion thereof for discharge of the gas, a pair of opposing gas permeable retaining walls of nonlinear zigzag configuration positioned within said upright housing and extending generally longitudinally thereof in closely spaced relation to one another to define an elongate generally vertically extending passageway of relatively narrow cross section adapted for receiving the aggregate at the upper end thereof and directing the same along a predetermined sinuous downward path of travel in the form of a relatively thin downwardly moving layer, each of said opposing gas permeable retaining walls being comprised of a series of laterally extending spaced apart slats interconnected to define inclined segmental wall portions inclined at an angle within the range of about 10° to about 25° from the vertical axis and so arranged that alternate segmental wall portions are inclined to one side of the vertical axis, with the intervening segmental wall portions being inclined to the opposite side of the vertical axis and with the slats of the opposing series being convergingly arranged and inclined angularly downwardly in the direction of movement of the aggregate and positioned in overlapping relation to one another to assist in guiding the aggregate along its downward path of travel while confining the aggregate within the passageway and while also readily permitting the flow of heated gas into and through the thin layer of aggregate, means cooperating with the respective segmental wall portions of said pair of retaining walls and with the surrounding housing for directing the gas flowing within said housing successively through each of said segmental wall portions so as to thereby repeatedly direct the flowing gas laterally back and forth through the thin layer of aggregate in said passageway to provide highly effective contact of the gas with the aggregate, and means cooperating with said pair of retaining walls adjacent the lower end thereof for controlling the discharge of the aggregate from said passageway.

9. The apparatus as set forth in claim 8 wherein said means for controlling the discharge of the aggregate from said passageway comprises an elongate roll mounted beneath said pair of retaining walls and cooperating therewith to obstruct the lower end of said passageway, and means for rotating said roll so as to thereby effect discharge of the aggregate from said passageway at a controlled rate.

10. The apparatus as set forth in claim 8 wherein said means cooperating with said segmental wall portions for directing the heated gas successively through each of said segmental wall portions comprises respective baffle plates extending between certain of said segmental wall portions and the surrounding housing.

11. The apparatus as set forth in claim 10 wherein said baffle plates are arranged at an incline extending angularly downwardly and outwardly from said segmental wall portion to the surrounding housing so that any fine particulate material which might escape from said passageway and become deposited on the baffle plate will be directed by gravity downwardly along the surface of the baffle plate toward said housing, and including means associated with said baffle plates to facilitate collecting and removing the fine particulate material.

12. Apparatus for treating a solid aggregate with a flowing gas, said apparatus comprising an upright hollow housing having an inlet opening in a lower portion thereof for receiving a flowing gas and an outlet opening in an upper portion thereof for discharge of the gas, a pair of opposing gas permeable retaining walls positioned within said upright housing and extending generally longitudinally thereof in closely spaced relation to one another to define an elongate generally vertically extending passageway of relatively narrow cross section adapted for receiving the aggregate at the upper end thereof and directing the same along a predetermined downward path of travel in the form of a relatively thin downwardly moving layer, said pair of retaining walls being of nonlinear zigzag configuration, and each comprised of a series of interconnected inclined segmental wall portions so arranged as to direct the thin layer of aggregate along a sinuous path of travel in the course of its downward movement along said elongate passageway, means cooperating with the respective segmental wall portions of said pair of retaining walls and with the surrounding housing for directing the gas flowing within said housing successively through each of said segmental wall portions so as to thereby repeatedly direct the flowing gas laterally back and forth through the thin layer of aggregate in said passageway to provide highly effective contact of the gas with the aggregate, said means comprising respective baffle plates extending between certain of said segmental wall portions and the surrounding housing and each arranged at an incline extending angularly downwardly and outwardly from said segmental wall portion to the surrounding housing so that any fine particulate material which might escape from said passageway and become deposited on the baffle plate will be directed by gravity downwardly along the surface of the baffle plate toward said housing, means associated with said baffle plates to facilitate collecting and removing the fine particulate material, and means cooperating with said pair of retaining walls adjacent the lower end thereof for controlling the discharge of the aggregate from said passageway.

13. A method of continuously treating a solid aggregate with a flowing gas, said method comprising confiningly directing the aggregate downwardly through a passageway of relatively narrow cross section defined by a pair of opposing gas permeable retaining walls of nonlinear zigzag configuration to confine the aggregate in an elongate generally vertically extending relatively thin layer and wherein each of the retaining walls is formed of a series of laterally extending spaced apart slats interconnected and arranged to define inclined segmental wall portions inclined at an angle within the range of 10° to about 25° from the vertical axis and so that alternate segmental wall portions are inclined to one side of the vertical axis with the intervening segmental wall portions being inclined to the opposite side of the vertical axis and with the slats of the opposing series convergingly arranged and inclined angularly downwardly in the direction of movement of the thin layer of aggregate and positioned in overlapping relation to one another to assist in guiding the aggregate along its downward path of travel, and directing a flowing gas upwardly along a predetermined sinuous path of travel passing repeatedly back and forth through the layer of aggregate and successively laterally through each of the inclined segmental wall portions, with the opposing series of slats defining the same directing the flowing gas into the thin layer of aggregate in an angularly downward direction so as to assist in moving the thin layer of aggregate in its downward path of travel along the passageway and directing the gas out of the thin layer of aggregate in an inclined angularly upward direction so as to assist in removing and carrying away fine particulate material, such as dust, from the thin layer of aggregate.

14. In a method for heat treating a solid aggregate wherein the aggregate is advanced longitudinally through an elongate rotary kiln while a heated gas is directed through the kiln in a direction countercurrent to the movement of the aggregate for heating the aggregate to elevated temperature, the combination therewith of an improved method for utilizing the heated gas which is discharged from the kiln as a waste gas for preheating the aggregate prior to introduction thereof into the kiln to thus significantly reduce the energy requirements for heat treatment of the aggregate while also significantly increasing the production capacity of the kiln, said method comprising confiningly directing the aggregate downwardly through a passageway of relatively narrow cross section defined by a pair of opposing gas permeable retaining walls of nonlinear zigzag configuration to confine the aggregate in an elongate generally vertically extending relatively thin layer and wherein each of the retaining walls is formed of a series of laterally extending spaced apart slats interconnected and arranged to define inclined segmental wall portions inclined at an angle within the range of 10° to about 25° from the vertical axis and so that alternate segmental wall portions are inclined to one side of the vertical axis with the intervening segmental wall portions being inclined to the opposite side of the vertical axis and with the slats of the opposing series convergingly arranged and inclined angularly downwardly in the direction of movement of the thin layer of aggregate and positioned in overlapping relation to one another to assist in guiding the aggregate along its downward path of travel, and directing the heated gas from the kiln upwardly along a predetermined sinuous path of travel passing repeatedly back and forth through the layer of aggregate and successively laterally through each of the inclined segmental wall portions, with the opposing series of slats defining the same directing the flowing gas into the thin layer of aggregate in an angularly downward direction so as to assist in moving the thin layer of aggregate in its downward path of travel along the passageway and directing the gas out of the thin layer of aggregate in an inclined angularly upward direction so as to assist in removing and carrying away fine particulate material, such as dust, from the thin layer of aggregate whereby the heat content of the gas is effectively transferred to the aggregate to avoid waste thereof.

15. In a method for heat treating a solid aggregate wherein the aggregate is advanced longitudinally through an elongate rotary kiln while a heated gas is directed through the kiln in a direction countercurrent to the movement of the aggregate for heating the aggregate to elevated temperature, and wherein the heated gas from the rotary kiln is discharged as a waste gas which is filtered prior to discharge to the atmosphere to remove entrained particulate material from the gas, the combination therewith of an improved method for utilizing the heated gas which is discharged from the kiln for preheating the aggregate prior to introduction thereof into the kiln to thus significantly reduce the energy requirements for heat treatment of the aggregate while also significantly increasing the production capacity of the kiln and while also lowering the temperature of the waste gas to a sufficiently low level to permit filtration thereof without first requiring further cooling, said method comprising confiningly directing the aggregate downwardly through a passageway of relatively narrow cross section defined by a pair of opposing gas permeable retaining walls of nonlinear zigzag configuration to confine the aggregate in an elongate generally vertically extending relatively thin layer and wherein each of the retaining walls is formed of a series of laterally extending spaced apart slats interconnected and arranged to define inclined segmental wall portions inclined at an angle within the range of 10° to about 25° from the vertical axis and so that alternate segmental wall portions are inclined to one side of the vertical axis with the intervening segmental wall portions being inclined to the opposite side of the vertical axis and with the slats of the opposing series convergingly arranged and inclined angularly downwardly in the direction of movement of the thin layer of aggregate and positioned in overlapping relation to one another to assist in guiding the aggregate along its downward path of travel, and directing the heated gas from the kiln upwardly along a predetermined sinuous path of travel passing repeatedly back and forth through the layer of aggregate and successively laterally through each of the inclined segmental wall portions, with the opposing series of slats defining the same directing the flowing gas into the thin layer of aggregate in an angularly downward direction so as to assist in moving the thin layer of aggregate in its downward path of travel along the passageway and directing the gas out of the thin layer of aggregate in an inclined angularly upward direction so as to assist in removing and carrying away fine particulate material, such as dust, from the thin layer of aggregate, to thus effectively transfer the heat content of the waste gas to the aggregate and cool the gas to such a low temperature as to permit filtration of the gas without danger of damage to the filter, and conveying the thus cooled gases directly to the filter for filtration thereof prior to discharge to the atmosphere.

* * * * *